US006615705B2

(12) United States Patent
Reinelt et al.

(10) Patent No.: US 6,615,705 B2
(45) Date of Patent: Sep. 9, 2003

(54) HYDRAULIC CYLINDER

(75) Inventors: Werner Reinelt, Bochum (DE); Friedrich-Wilhelm Dannehl, Hagen (DE)

(73) Assignee: DBT GmbH (DE)

( * ) Notice: Subject to any disclaimer, the term of this patent is extended or adjusted under 35 U.S.C. 154(b) by 0 days.

(21) Appl. No.: 09/951,059

(22) Filed: Sep. 13, 2001

(65) Prior Publication Data

US 2002/0046650 A1 Apr. 25, 2002

(30) Foreign Application Priority Data

Sep. 15, 2000 (DE) ..... 100 45 680

(51) Int. Cl.[7] ..... F01B 31/10
(52) U.S. Cl. ..... 92/153; 91/169
(58) Field of Search ..... 92/153, 165 R, 92/52; 91/169

(56) References Cited

U.S. PATENT DOCUMENTS

| | | | | |
|---|---|---|---|---|
| 2,321,927 A | * | 6/1943 | McCoy et al. | 277/513 |
| 3,983,789 A | | 10/1976 | Dodt et al. | |
| 4,211,151 A | * | 7/1980 | Wallischeck | 92/165 R |
| 5,015,000 A | * | 5/1991 | Perini | 92/165 R |
| 5,052,278 A | * | 10/1991 | Smillie et al. | 92/153 |
| 5,429,038 A | * | 7/1995 | Black | 92/153 |
| 5,921,554 A | | 7/1999 | Derian et al. | |
| 6,209,440 B1 | | 4/2001 | Dannehl et al. | |

FOREIGN PATENT DOCUMENTS

| | | |
|---|---|---|
| DE | 196 21 441 C1 | 8/1997 |
| GB | 876483 | 9/1961 |
| GB | 948255 | 1/1964 |

* cited by examiner

*Primary Examiner*—Edward K. Look
*Assistant Examiner*—Igor Kershteyn
(74) *Attorney, Agent, or Firm*—Cook, Alex, McFarron, Manzo, Cummings & Mehler, Ltd.

(57) ABSTRACT

A hydraulic cylinder (10), especially as a pit prop or moving cylinder unit in underground mining, with a locking ring (16) arranged on an outer cylinder tube (11) sealing it at its end with a lead through for an axially movable rod element (12; 13) accommodated in it. The locking ring (16) is provided in the lead through surrounding the rod element (12; 13) with a sealing arrangement (22) resting on the outer side (34) of the rod element (12; 13). The sealing arrangement (22) has a guide ring (29) provided with grease grooves (33) open to the outer side (34) of the rod element (12, 13), which can, be supplied with lubricant for the grease grooves (33) via a lubricant line (35) accessible on the outside on the hydraulic cylinder (10) and which is arranged in an accepting groove (40) formed interlocking ring (16) between an axially inner and an axially outer collar (38; 39). The gap (41) formed between the outer collar (39) and the rod element (12, 13) is greater than the gap (42) between the rod element ((12; 13) and the inner collar (38) and that the guide ring (29) is arranged axially inside adjacent to an axial further outward lying O-ring seal (28).

10 Claims, 2 Drawing Sheets

FIG. 2
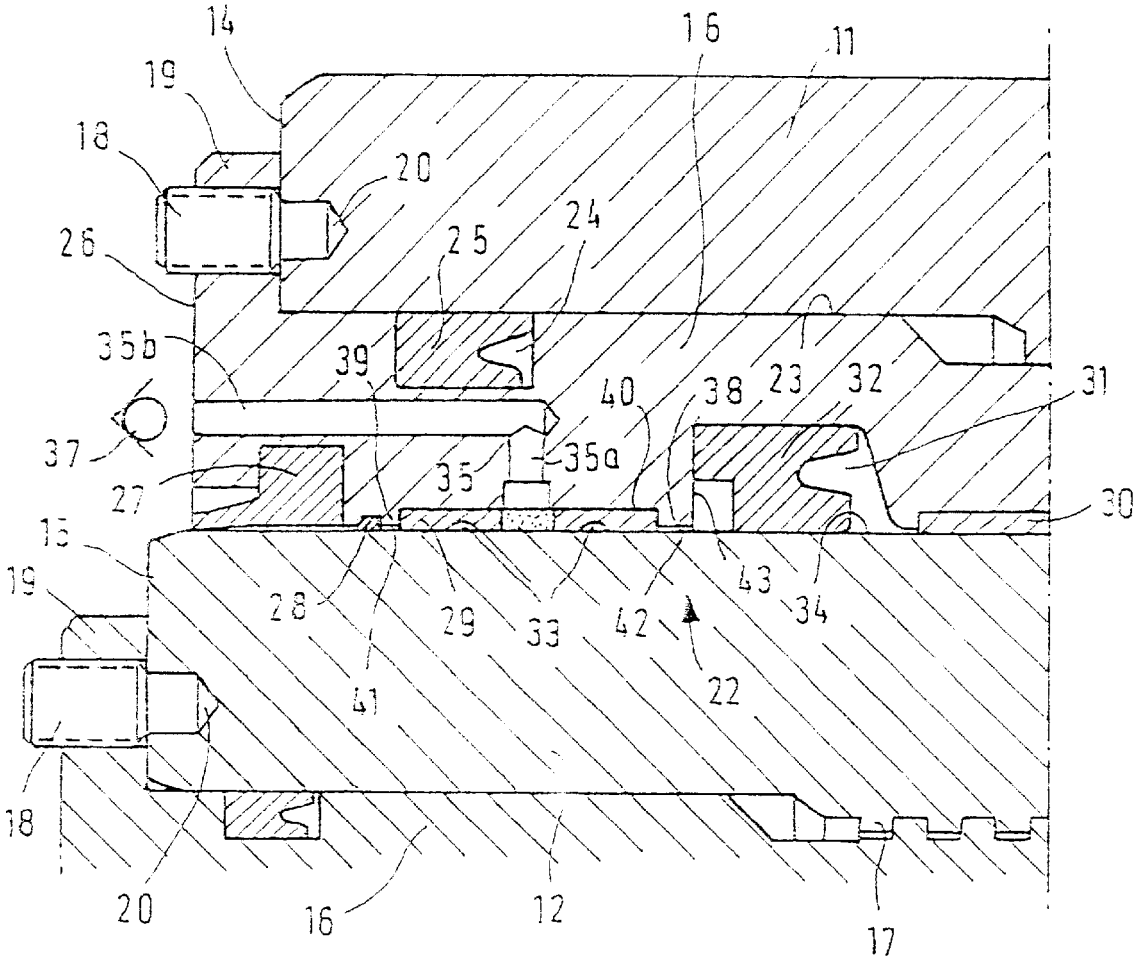
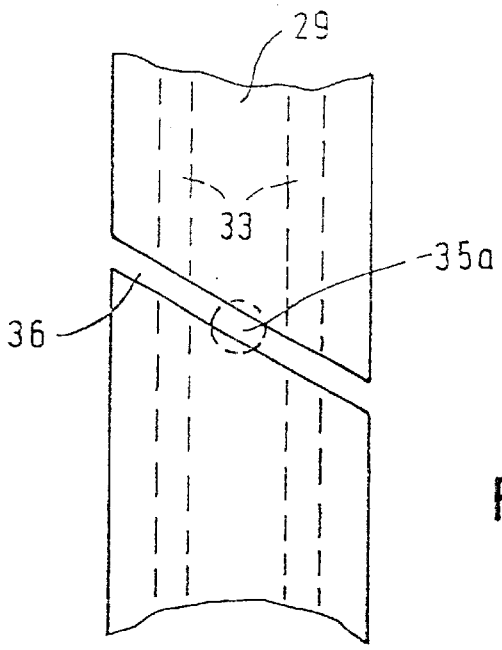
FIG. 3

HYDRAULIC CYLINDER

The invention relates to a hydraulic cylinder, especially as a pit prop or moving cylinder unit in underground mining, with a locking ring arranged on an outer cylinder tube sealing it at its end with a lead through for an axially movable rod element accommodated in it, whereby the locking ring is provided in the lead through surrounding the rod element with a sealing arrangement resting on the outer side of the rod element.

Hydraulic cylinders of this construction find frequent application in underground mining as telescopic pit props for fact support. They find application in other areas or mining also, for instance as moving cylinders in self-advancing supports, where they serve to move a conveyor in the direction of the face advance and then by retraction to retrieve a support frame connected to them.

As a consequence of the rough operating conditions underground, after a relatively short operational period the hydraulic cylinders used there incur damage to the sliding surfaces between the outer cylinder tube and the inner rod element, which often lead to loss of sealing. The region of the locking ring is here especially problematical at which an escape of hydraulic fluid first arises on damage to the rod element on its outside and/or damage to the sealing arrangement.

A hydraulic cylinder constructed as a hydraulic double telescopic prop of the generic construction is known from DE 196 47 943 C1. In this known hydraulic cylinder guide rings in the two locking rings between the outer tube and the intermediate tube on the one hand and the intermediate tube and the inner rod on the other hand cater for the guidance of the extensible parts with very little radial play, and the additionally provided rod sealing rings accepted in grooves in the locking ring can undertake their sealing function against an escape of hydraulic fluid in an especially reliable manner.

The known arrangement has proved itself in practice; it is however a disadvantage that, because of the small play between the guide rings and the rod elements guided by them (intermediate tube and piston rod) these are subject to a high degree of wear on their outer circumference and the sealing has therefore even here a limited life time.

It is the aim of the present invention to produce a hydraulic cylinder of the construction quoted in the opening paragraph, with an especially long life sealing arrangement, which at the same time realises the highly accurate Guidance during extension and retraction of the telescopic elements with the smallest possible play in the radial direction.

Accordingly the present invention is directed to a hydraulic cylinder as described in the opening paragraph of the present specification, in which the sealing arrangement has a guide ring provided with grease grooves open to the outer side of the rod element, which can be supplied with lubricant for the grease grooves via a lubricant line accessible on the outside on the hydraulic cylinder and which is arranged in an accepting groove formed in the locking ring between an axially inner and an axially outer collar, whereby the gap formed between the outer collar and the rod element is greater than the gap between the rod element (and the inner collar and that the guide ring is arranged axially inside adjacent to an axial further outward lying O-ring seal.

The construction according to the invention has the especial advantage that a film of lubricant is built up on the outer side of the rod element through the grease grooves provided in the guide ring, which effectively prevents any direct contact between the rod element and the guide ring guiding it and thereby facilitates an almost friction-free extension and retraction of the rod element. Since the lubricant feeder is accessible from outside on the hydraulic cylinder, as necessary either manually or with the aid of an automatic greasing device, lubricant can be regularly replenished, so that "dry running" of the rod element in the cylinder tube does not occur.

The inner collar thereby forms on its end surface facing away from the guide ring the greatest possible abutment for the rod sealing ring. The larger gap formed between the outer collar and the rod ensures that superfluous lubricant does not escape in the direction of the inner collar and therewith in the direction of the rod sealing ring, but in the opposite direction where the lubricant is presented with only a smaller resistance, so that it can easily be forced outward in the direction of the wiping ring and can be forced under this and thereby any pollutants which have possibly entered can be carried out again.

Advantageously the guide ring is arranged in the sealing arrangement between an outer wiper ring and a rod sealing ring arranged axially further inward on the locking ring. The outer wiper ring ensures that on retraction of the rod element any dirt adhering to its outside is wiped off and is not transported into the inside of the hydraulic cylinder. The guide ring with its lubricant reliably distributed over the entire surface of the rod element via the guide grooves, preferably an environmentally friendly grease, reliably prevents the remainder of the dirt which has not been removed by the wiper ring, or moisture, being able to penetrate as far as the rod sealing ring, so that this is kept always absolutely clean and thus can maintain its sealing function over a long period.

Especially the sealing arrangement has a second guide ring at an axial separation from the first guide ring. Expediently the rod sealing ring is arranged between the two guide rings.

In a preferred embodiment the first and/or the second guide ring comprises a hard woven material. Advantageously they can be singly or multiple divided, which significantly eases their assembly in the locking ring.

Especially the first guide ring is divided once and has a somewhat axial or diagonally running division, into which the lubricant line opens. The distribution of the lubricant is effected here in an especially simple manner in that the lubricant first reaches the joint and from this into the grease grooves.

In a preferred embodiment the lubricant line has a first section running radially in the locking ring with an opening in the region of the first guide ring and a second section, which runs axially through the locking ring and at whose front end can be filled via a non-return valve. In this form of embodiment it is ensured that not only is the sealing arrangement completely accepted in the locking ring, but also the associated lubricant supply which then can be exchanged as a unit with the sealing arrangement by exchanging the locking ring, when this becomes necessary after a long operating period of the hydraulic cylinder.

Advantageously the O-ring seal is arranged between the first guide ring and the wiper ring. Owing to the excellent lubrication in addition to the good sealing provided it is possible to provide the rod element with a plastics material coating, which owing to the use of the new construction of guide ring with grease grooves is no longer damaged by the guide ring as in the state of the technology and which thus forms a long-lasting protection of the rod element against corrosion.

Especially when used as a pit prop the hydraulic cylinder according to the invention can be made multi-stage, with an inner prop element, an inner tube element surrounding it and an outer cylinder again surrounding the latter. The inner tube element thereby forms on one side the cylinder tube for the rod element and represents on the other side a, rod element itself for the outer cylinder tube as is well known in multi-stage hydraulic cylinders.

An example of a hydraulic cylinder made in accordance with the present invention will now be described herein below with reference to the accompanying drawings, in which:

FIG. 2 shows a detail II from FIG. 1 in enlarged scale in the region of the locking ring between the outer cylinder tube and the inner tub element arranged movably in it; and FIG. 3 shows a section of the guide ring coming into application in the sealing arrangement according to the invention in one layout.

Figure 1:
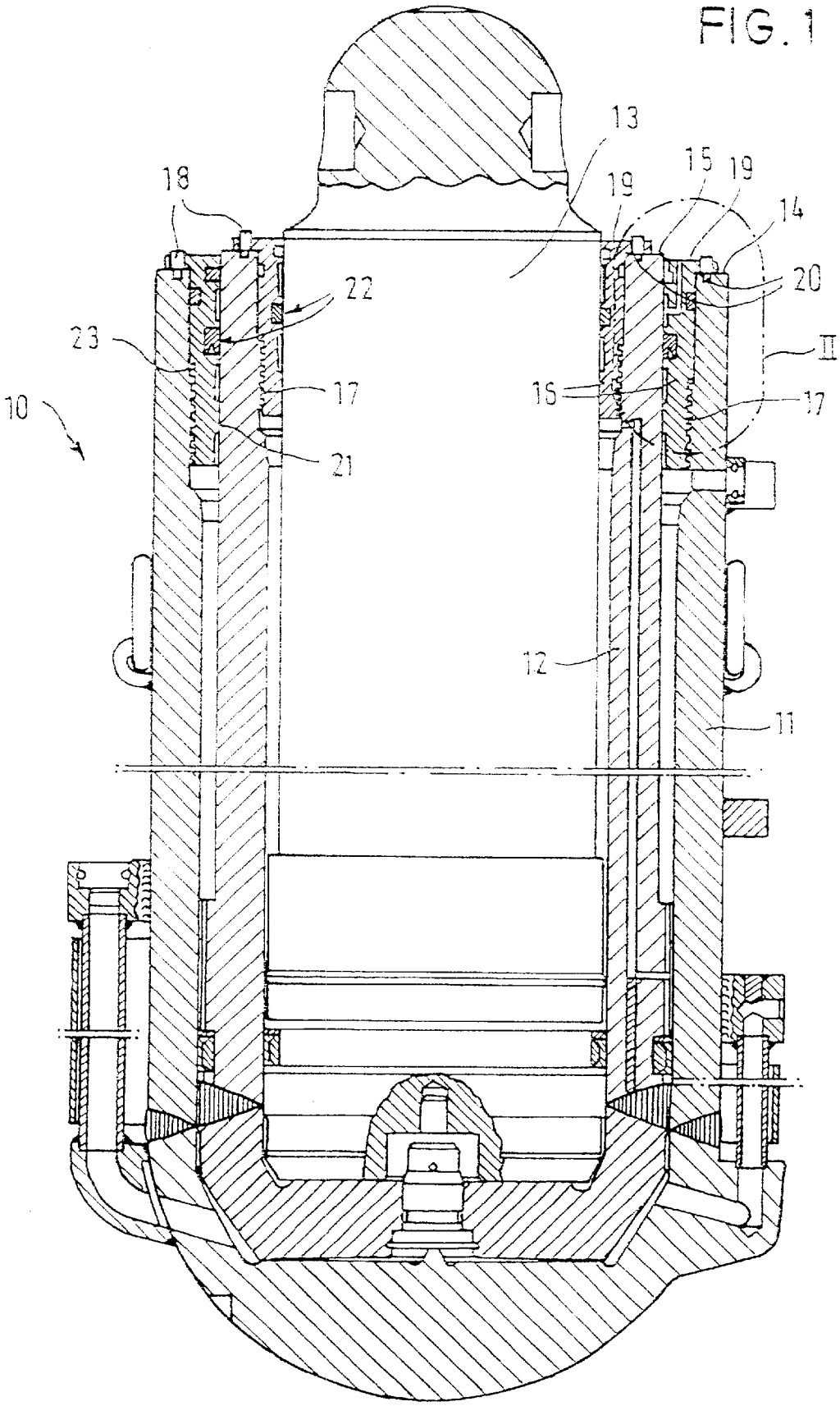
FIG. 1 shows a longitudinal section of a two stage hydraulic cylinder for use as a pit prop.

A hydraulic cylinder 10 is shown in its entirety in FIG. 1 and serves as a pit prop or roof support in underground mining. It is constructed as a double telescopic prop and has in a previously proposed construction of an outer cylinder tube 11, an inner tube element 12 arranged to slide in it and an inner rod element 13 is again accepted to slide in this. The inner tube element 12 itself forms on the one hand the cylinder tube for the inner rod element 13, is on the other hand however itself a rod element in relation to the outer cylinder tube. The concept of "rod element", as it is used in the following description can thus denote both the inner rod 13 and also the inner tube element 12.

For the sealing closure of the outer cylinder tube against the moving rod element locking rings 16 are screwed removably at the upper ends 14 and 15 of the outer cylinder tube 11 and of the inner tube element 12 in internal threads 17 on the outer cylinder tube 11 and on the inner tube element 12 and secured against unintentional loosening. Securing pins 18 are used for this, which engage through a flange 19 on the locking rings into locking holes 20 or the front ends 14, 15 of the rod element and the inner tube element.

For the reliable sealing of the rod elements 12, 13, axially movable in the cylinder tubes, sealing arrangements 22 are provided on the inner side 21 of the locking rings 16, whose construction is best seen from FIG. 2. The sealing arrangements on the inner and outer locking rings are essentially constructed the same and differ only in the size of the sealing elements applied; below is described therefore only the sealing arrangement between the locking ring on the outer cylinder tube 11 and the inner tube element 12 moving axially within it, which will also be designated as a rod element.

As can be well seen from FIG. 2, the locking ring 16 is provided with a grove 24 on its outer circumference 23 and a profile ring seal 25 accepted in it which caters for the sealing of the locking ring 16 against the outer cylinder 11.

On its inner circumference 21 the locking ring has, starting from its outer front end 26 first a wiper ring 27 and an O-ring seal 28 lying immediately adjacent to it, whose main task comprises wiping off, whilst it is retracting, any pollutants and/or water present on the outer circumference of the inner tube element 12 and to prevent dust and moisture reaching the parts of the sealing arrangement 22 placed further in. These essentially comprise a first guide ring 29 lying axially further out and a second guide ring 30 lying axially inside, between which a circulating groove 31 is arranged in the locking ring 16 in which a rod sealing ring 32 is accommodated which represents the main element the sealing arrangement and therefore ensures that the high pressure of hydraulic fluid operating in the outer cylinder tube 11 on the inner tube element 12 cannot escape at the upper end 14 of the hydraulic cylinder. The guide rings 29 and 30 arranged immediately in front of and behind the rod sealing ring 32 ensure an exactly concentric guidance of the inner tube element 12 forming the prop, so that this runs exactly concentrically through the rod sealing ring 32 and is equally well sealed over its entire circumference.

in accordance with the invention the first axially outer lying guide ring which s not wetted by hydraulic fluid, is provided with lubricating grooves 33, which are open to the outer side 34 of the inner tube element 12 and can be supplied with a lubricating agent, preferably an environmentally friendly grease, via a lubricating line 35. The guide ring 29 comprises here a hard woven material and is simply divided, whereby its division 36,runs diagonally and is arranged in the locking ring 16 such that the lubricating line 35 opens between the two lubricating grooves 33. This arrangement can be well seen in FIG. 3.

The lubricating line has a first section 35*a* running radially in the locking ring and a second axial section 35*b*, which runs axially through the locking ring 16 and is closed at its front end 26 by a non-return valve 37. Onto the non-return valve 37, shown only schematically, can be connected a grease gun or a central lubricant supply in order to convey the lubricant through the lubricating line 35 into the grease grooves 33 in the first guide ring 29.

It can be recognised that the first guide ring is arranged in an accommodation pocket 40 between an axial inner collar 38 and an axial outer collar 39. The arrangement is so designed here that the gap 41 formed between the outer collar 39 and the outer side 34 of the inner tube element 12 is larger than the gap 42, which remains open between the inner collar 38 and the inner tube 12. It is ensured, owing to this arrangement, that superfluous lubricant which has been taken to the grease grooves 33 in the first guide ring 29, does not flow out in the direction of the rod sealing ring 32, but in the direction of the O-ring 28 and the wiper ring 27, which are dimensioned such that they permit the lubricant through to the outside. The inner collar 38 extending directly to the inner tube element 12 has the additional advantage that it forms a very large abutment face 43 for the rod seal 32, which can thereby be optimally supported in the axial direction on the inner collar 38.

The construction of the guide ring according to the invention with the associated lubricating device 35, 33 has the advantage that in spite of very close matching between the guide ring and the inner tube element 12 or the rod element 13 a thin film of lubricant reliably prevents damage to the surface of the inner tube element and to the rod element, so that the rod sealing ring can discharge its sealing function over a long period. It is possible under the invention to provide the outer side of the rod element and the inner tube element with a plastics material coating, which protects them reliably against corrosion, whereby damage to the plastics material coating by the guide ring itself, which regularly occurred with the known sealing arrangements with plastics material coated rods, is avoided as a consequence of the lubricant being applied there.

It is understood that the sealing arrangement on the inner locking ring between the rod element 13 and the inner tube element 12 is constructed correspondingly, even if the lubricant device 33, 35 is not shown here in FIG. 1. The invention is not limited to the embodiment represented and described, but many changes and extensions are conceivable, without departing from the framework of the invention. Thus for instance in individual cases it can be reasonable to provide the second guide ring 30 with grease grooves also and to connect them to the lubricant line 35. In general however in the third inner lying guide ring the hydraulic fluid there under continuous pressure provides a sufficient static lubrication.

The invention is not only usable for pit props, but can also find application in other hydraulic cylinders for hydraulic mining units.

What is claimed is:

1. A hydraulic cylinder, for use in underground mining, with a locking ring arranged on an outer cylinder tube sealing it at its end with an opening as defined by the locking ring which accommodates an axially movable rod element accommodated in it, whereby the locking ring is provided in the opening as defined by the locking ring which accommodates the rod element, with a sealing arrangement resting on the outer side of the rod element, in which the sealing arrangement has a guide ring provided with grease grooves open to the outer side of the rod element, which is supplied with lubricant for the grease grooves via a lubricant line accessible on the outside on the hydraulic cylinder and which is arranged in an accepting groove formed in the locking ring between an axially inner and an axially outer collar, whereby the gap formed between the outer collar and the rod element is greater than the gap between the rod element (and the inner collar and that the guide ring is arranged axially inside adjacent to an axial further outward lying O-ring seal.

2. A hydraulic cylinder according to claim 1, in which the guide ring is arranged in the sealing arrangement between an outer wiper ring and a rod sealing ring arranged axially further inward on the locking ring.

3. A hydraulic cylinder according to claim 1, in which the sealing arrangement has a second guide ring at an axial separation from the first guide ring.

4. A hydraulic cylinder according to claim 1, in which the first and/or the second guide ring comprises a hard woven material.

5. A hydraulic cylinder according to claim 1, in which the first and/or the second guide ring is divided singly or more times.

6. A hydraulic cylinder according to claim 5, in which the first guide ring is divided once and has a somewhat axial or diagonally running division, into which the lubricant line opens.

7. A hydraulic cylinder according to claim 1, in which the lubricant line has a first section running radially in the locking ring with an opening in the region of the first guide ring and a second section, which runs axially through the locking ring and at whose front end is filled via a non-return valve.

8. A hydraulic cylinder according to claim 1, in which the O-ring seal is arranged between the first guide ring and the wiper ring.

9. A hydraulic cylinder according to claim 1, in which it is multi-stage constructed with an inner rod element, an inner tube element surrounding it and an outer cylinder tube again surrounding the latter, whereby the inner tube element forms the cylinder tube for the rod element and represents the rod element itself for the outer cylinder tube.

10. A hydraulic cylinder according to claim 1, in which the rod element is provided with a plastics material coating.

* * * * *

UNITED STATES PATENT AND TRADEMARK OFFICE

CERTIFICATE OF CORRECTION

PATENT NO. : 6,615,705 B2 
DATED : September 9, 2003
INVENTOR(S) : Werner Reinelt and Friedrich-Wilhelm Dannehl It is certified that error appears in the above-identified patent and that said Letters Patent is hereby corrected as shown below:

Title page,
Item [*] Notice, please insert the following: -- [*] Notice: Subject to any disclaimer, the term of this patent is extended or adjusted under 35 U.S.C. 154(b) by 54 days. --

Signed and Sealed this

Twenty-seventh Day of January, 2004

JON W. DUDAS
*Acting Director of the United States Patent and Trademark Office*